US006669117B2

(12) United States Patent
Boecking

(10) Patent No.: US 6,669,117 B2
(45) Date of Patent: Dec. 30, 2003

(54) FUEL INJECTION VALVE FOR INTERNAL COMBUSTION ENGINES

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 111 days.

(21) Appl. No.: 09/936,214

(22) PCT Filed: Jan. 5, 2001

(86) PCT No.: PCT/DE01/00003

§ 371 (c)(1),
(2), (4) Date: Dec. 28, 2001

(87) PCT Pub. No.: WO01/51804

PCT Pub. Date: Jul. 19, 2001

(65) Prior Publication Data

US 2003/0057298 A1 Mar. 27, 2003

(30) Foreign Application Priority Data

Jan. 8, 2000 (DE) ..... 100 00 501

(51) Int. Cl.[7] ..... F02M 39/00

(52) U.S. Cl. ..... 239/533.3; 239/533.13; 239/584

(58) Field of Search ..... 239/533.1, 533.3, 239/533.8, 533.9, 533.11, 533.13, 583, 584, 602

(56) References Cited

U.S. PATENT DOCUMENTS

| | | | | | |
|---|---|---|---|---|---|
| 4,470,548 | A | * | 9/1984 | Ushimura | 239/533.3 |
| 4,658,824 | A | * | 4/1987 | Scheibe | 239/533.3 |
| 5,738,283 | A | * | 4/1998 | Potz et al. | 239/533.3 |
| 5,890,660 | A | * | 4/1999 | Stevens | 239/533.3 |
| 6,047,905 | A | * | 4/2000 | Honda et al. | 239/533.2 |

* cited by examiner

*Primary Examiner*—Steven J. Ganey
(74) *Attorney, Agent, or Firm*—Ronald E. Greigg

(57) ABSTRACT

A fuel injection valve for internal combustion engines, having a valve body a bore in which a valve member is disposed to be axially movable counter to a closing force. On its end, the valve member has a substantially conical valve member tip, which with a part of its jacket face that serves as a valve sealing face comes to rest on a valve seat, embodied on the end toward the combustion chamber of the bore. At the transition from the valve member to the valve member tip, an annular groove undercuts the valve sealing face in part and thereby forms an annular collar, which is resiliently yielding. The cone angle of the valve sealing face, in the open position of the valve member, is somewhat larger than the cone angle of the valve seat, so that in the closing motion of the valve member toward the valve seat, the annular collar is first seated with the outer sealing edge and is deformed inward by the further closing motion. The sealing edge is thus not press-fitted into the valve seat, and as a result the seat diameter remains unchanged over the service life of the fuel injection valve.

6 Claims, 3 Drawing Sheets

FUEL INJECTION VALVE FOR INTERNAL COMBUSTION ENGINES

CROSS-REFERENCE TO RELATED APPLICATIONS

This application is a 35 USC 371 application of PCT/DE 01/00003 filed on Jan. 5, 2001.

BACKGROUND OF THE INVENTION

1. Field of the Invention

The invention is directed to a fuel injection valve for internal combustion engines.

2. Description of the Prior Art

One fuel injection valve of the type with which this invention is concerned is known from German Published, Nonexamined Patent Application DE 196 08 575. On the end toward the combustion chamber of the valve member, a substantially conical tip is formed. This tip is divided into two portions; the tip cone angle of the outer portion, toward the combustion chamber, is greater than that of the inner portion, toward the valve member. As a result, an encompassing annular edge is embodied as a sealing face on the jacket face of the valve member tip.

The valve member is disposed in a bore, embodied as a blind bore, and the closed end, toward the combustion chamber, is embodied as a valve seat, which substantially has a conical shape. At least one injection opening is embodied in the valve seat and connects the interior of the valve with the combustion chamber, when the valve member is lifted from the valve seat.

In the closing position of the fuel injection valve, the valve member with its valve sealing face comes to rest on the valve seat. The cone angle of the valve seat is dimensioned such that the valve member is seated on the valve seat essentially only with its annular edge. On the one hand, this produces good sealing of the pressure chamber from the injection openings, but on the other it raises the problem that because of the high pressure per unit of surface area, deformations of the valve member and valve seat occur over time. The annular edge and/or the valve seat deform, causing the effective seat diameter of the valve member to change. As a result, the effective flow cross section of the fuel injection valve also changes, as does the size of the faces on the valve member that are subjected to pressure, which adversely affects the course of fuel injection and the injection precision.

SUMMARY OF THE INVENTION

The fuel injection valve of the invention has the advantage over the prior art that the part of the valve member tip bearing the valve sealing face is embodied as a yielding annular collar, and as a result in the closing position of the valve member, the part bearing the valve sealing face, after an initial line contact, rests two-dimensionally on the valve seat. The outer edge of the annular collar defines a fixed seat diameter. Because of the increasing bearing area of the valve member on the valve seat, a relatively small pressure per unit of surface area exists in the region of the valve seat, leading to less wear in this region. Thus the seat diameter remains constant over the service life of the fuel injection valve.

In an advantageous feature, the valve sealing face is partly undercut by the annular groove, so that the annular collar is embodied in liplike fashion to an increased extent, and the deformation work of the annular collar is reduced. By varying the shape of the annular groove, the yielding of the annular collar can be adapted to the applicable material comprising the valve member and the valve body.

BRIEF DESCRIPTION OF THE DRAWINGS

Further advantages and features of the invention can be learned from the detailed description contained below, taken with the drawings, in which.

DESCRIPTION OF THE PREFERRED EMBODIMENTS

Figure 1:
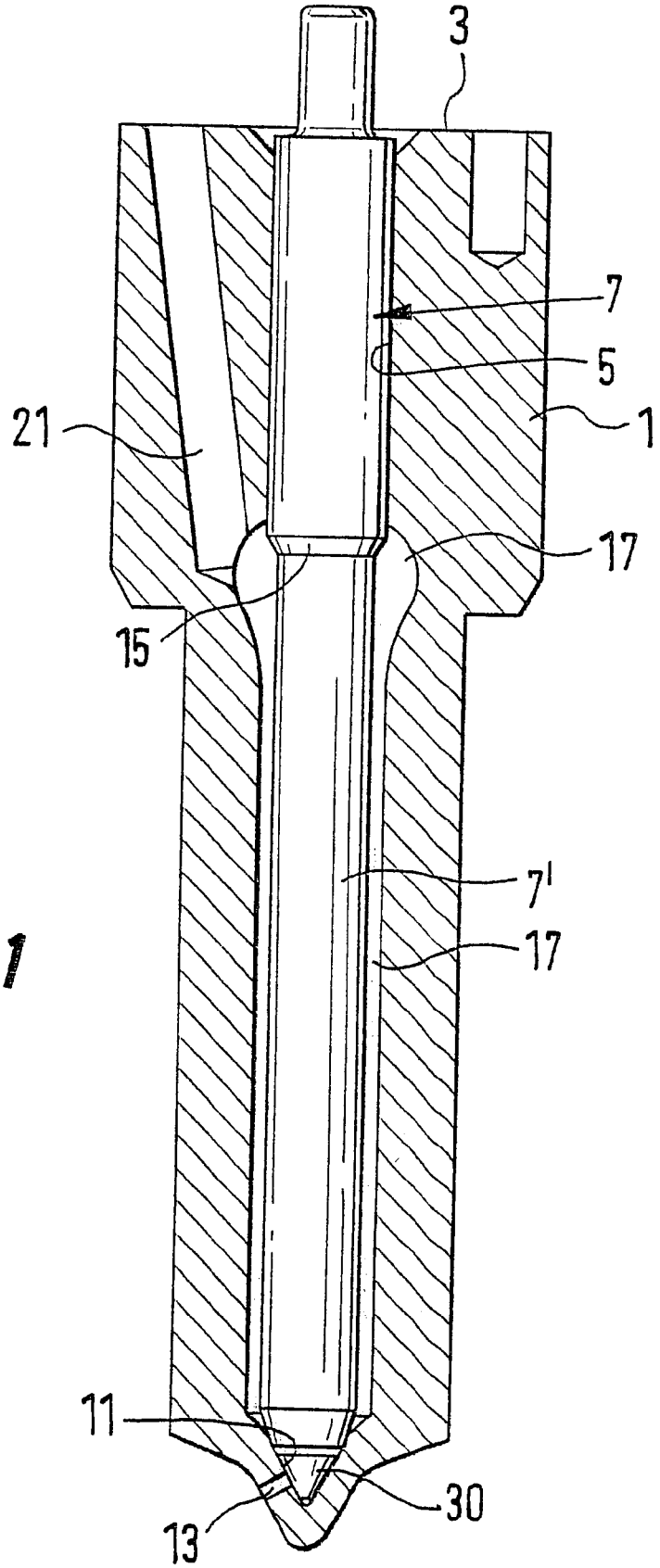
FIG. 1 shows a longitudinal section through a valve body with a valve member.

In FIG. 1, a longitudinal section is shown through an exemplary embodiment of the fuel injection valve of the invention. A valve body 1, whose end face remote from the combustion chamber, in the installed position, comes at least indirectly to rest on a valve retaining body, not shown in the drawing, has a bore 5 embodied as a blind bore. The bottom face is embodied as a valve seat 11 and is approximately conical, with a cone angle a (see FIG. 3), and the inside diameter of the valve seat 11 decreases toward the combustion chamber. At least one injection opening 13, which connects the bore 5 to the combustion chamber, is embodied at the valve seat 11.

Disposed in the bore 5 is a pistonlike valve member 7, which is guided in the bore 5 with a larger-diameter portion, remote from the combustion chamber, and which toward the combustion chamber changes into a smaller-diameter valve member shaft 7', thereby forming a pressure shoulder 15. Between the wall of the bore 5 and the valve member shaft 7', a pressure chamber 17 is formed, which surrounds the valve member 7 and the pressure shoulder 15 and extends as far as the valve seat 11. An inlet conduit 21, embodied in the valve body 1, by way of which the pressure chamber 17 can be filled with fuel at high pressure discharges into the pressure chamber 17.

On the end toward the combustion chamber, the valve member shaft 7' changes into a valve member tip 30, whose outer jacket face is approximately conical and forms a valve sealing face 9 (FIGS. 2 and 3), which cooperates with the valve seat 11. By the force of a closing spring, not shown in the drawing, the valve member 7 is pressed with the valve sealing face 9 against the valve seat 11, so that in this closing position, the injection opening 13 is sealed off from the pressure chamber 17 by the valve sealing face 9. In the open position of the valve member 7, that is, when the valve sealing face 9, as the result of an axial motion of the valve member 7 away from the combustion chamber, lifts from the valve seat 11, counter to a closing force and under the influence of the fuel, delivered to the pressure chamber 17 at high pressure, the pressure chamber 17 communicates with the combustion chamber via the injection opening 13, and fuel is injected into the combustion chamber.

Figure 2:
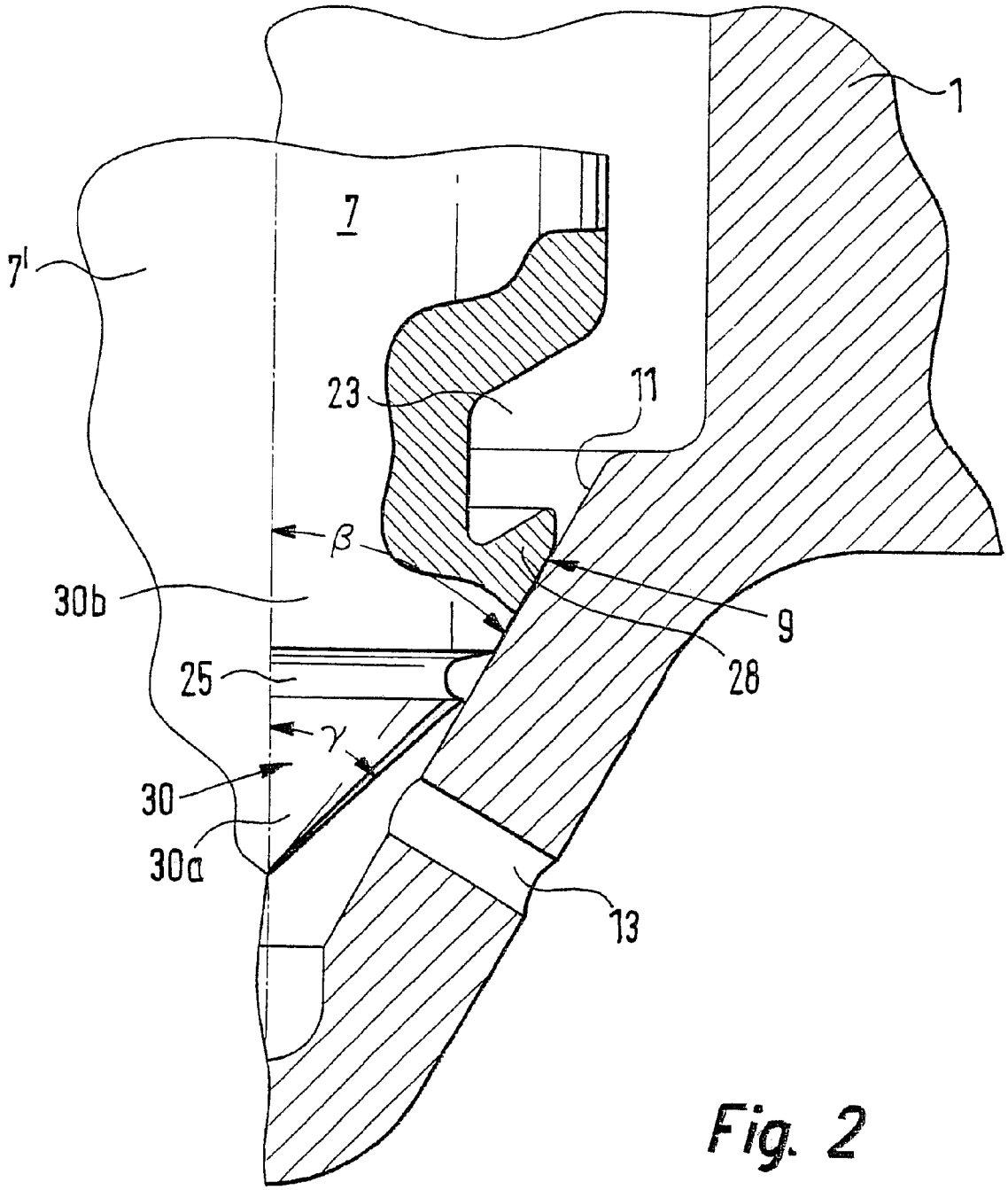
FIG. 2 is an enlarged detail of FIG. 1 in the region of the valve seat.

In FIG. 2, an enlargement of the fuel injection valve shown in FIG. 1 is shown in the closed position, in the region of the valve seat 11. The jacket face of the valve member tip 30 is divided into two portions, separated from one another by an annular furrow 25. The first valve member portion 30*a*, forming the end of the valve member 7, has a conical jacket face with a cone angle γ, while the second valve member portion 30*b*, which adjoins the annular furrow 25 to the side of the valve member shaft 7', has a frustoconical jacket face with a cone angle β. The cone angle γ is greater than the cone angle β, and the two portions of the valve member tip 30 are embodied such that only the jacket face of the second, frustoconical valve member portion 30*b* bears the valve sealing face 9.

At the transition from the valve member shaft 7' to the valve member tip 30, or to the second conical portion 30*b*, an annular groove 23 is formed, which isolates the second valve member portion 30*b* that bears the valve sealing face 9 and is preferably embodied in such a way that it partly undercuts the portion 30*b*. As a result, an annular collar 28 is formed, which is resiliently yielding and thus, upon contact with the valve seat 11, can adapt by deformation, under the influence of the closing force, to the valve seat 11. The annular furrow 25 disposed at the transition between the two valve member portions 30*a*, 30*b* of the valve member tip 30 assures a better distribution of fuel in the volume between the valve member tip 30 and the valve seat 11, in the event that more than one injection opening 13 is provided on the valve seat 11. The annular furrow 25 is located upstream of the outgoing injection openings 13.

Figure 3:
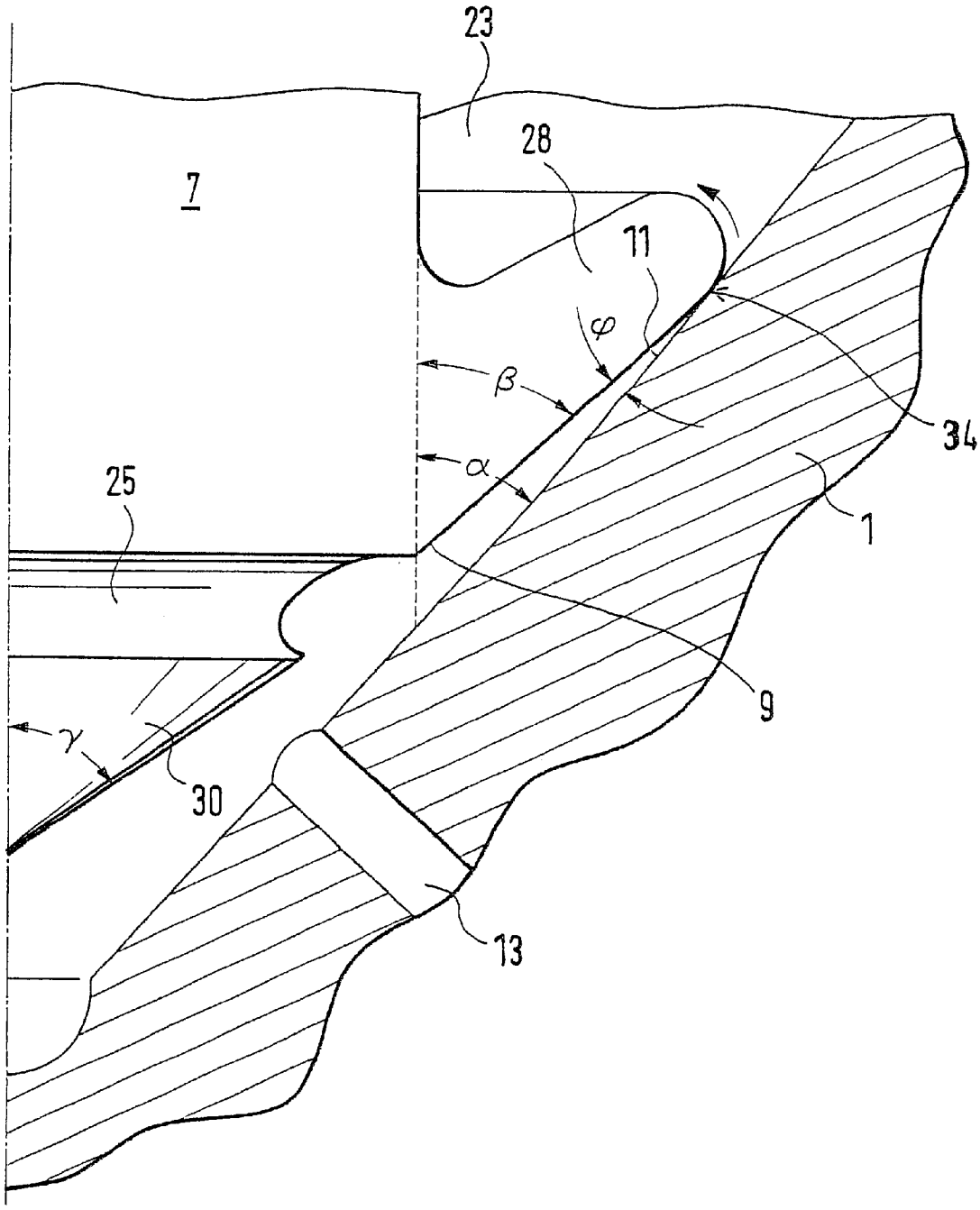
FIG. 3 is an enlarged detail of FIG. 2 in the region of the valve sealing face.

In FIG. 3, an enlargement of the valve member 7 in the region of the valve sealing face 9 is shown. The jacket face of the annular collar 28 has an opening angle β, which is not equal to but rather is somewhat larger than the cone angle α of the valve seat 11. The differential angle ϕ is dimensioned such that the annular collar 28, which in the closing position of the valve member 7 is pressed against the valve seat 11 by the force of the closing spring, can yield purely elastically inward perpendicular to the face of the valve seat 11 and thus rests two-dimensionally on the valve seat 11. The resilience is reinforced by the fact that part of the valve sealing face 9 is undercut by the annular groove 23, so that a reduced cross section is formed at the base of the annular collar.

The sealing edge 34, which forms the edge remote from the combustion chamber of the valve sealing face 9, is as a result of this design not pressed into the valve seat 11, since the full force of the closing spring acts on the valve seat 11 only after the deformation. The diameter of the initial contact of the valve member 7 with the valve seat 11 remains unchanged with use. To lessen the deformation work of the annular collar 28, with the goal of having a large valve sealing face 9 rest two-dimensionally on the valve seat 11, the differential angle ϕ between the cone angles of the valve sealing face 9 and valve seat 11 must be less than 1°, and preferably must be from 0.25 to 0.750.

In the closing position of the valve member 7 toward the valve seat 11, the sealing edge 34 first comes to rest on the valve seat 11. By the force of the closing spring, the valve member 7 is pressed farther onto the valve seat 11, causing the annular collar 28 to be pressed inward, until the entire frustoconical valve sealing face 9 comes to rest on the valve seat 11.

Instead of dividing the valve member tip 30 into two valve member portions 30*a*, 30*b* by means of an annular furrow, it can also provided that the annular furrow 25 is omitted, and as a result an annular edge is formed by the different cone angles of the two valve member portions 30*a*, 30*b* at the transition between them.

The foregoing relates to preferred exemplary embodiment of the invention, it being understood that other variants and embodiments thereof are possible within the spirit and scope of the invention, the latter being defined by the appended claims.

I claim:

1. A fuel injection valve for internal combustion engines, said valve comprising a valve body (1), having a bore (5) therein, a pistonlike valve member (7) disposed axially movably counter to a closing force in said bore, said valve member (7) being guided in a portion remote from the combustion chamber in said bore (5), while toward the combustion chamber through a cross-sectional reduction it changes into a valve member shaft (7') which protrudes into an annular chamber, embodied as a pressure chamber (17), between said bore (5) and valve member shaft (7'), a valve member tip (30), embodied on the end toward the combustion chamber of said valve member shaft (7'), which tip is substantially conical and whose outer diameter decreases away from the valve member shaft (7'), a valve seat (11) embodied on the end toward the combustion chamber of said bore (5) and having a substantially conical face, on which a jacket face of said valve member tip (30), as a valve sealing face (9), comes to rest upon motion of the valve member (7) in the direction of the closing force and thus seals off at least one injection opening (13) from the pressure chamber (17), an encompassing annular groove disposed between the transition from said valve member shaft (7') to said valve member tip (30) and said valve sealing face (9), whereby the part of said valve member tip (30) bearing said valve sealing face (9) is embodied resiliently and is elastically deformable perpendicular to the conical face of the valve seat (11).

2. The fuel injection valve of claims 1, wherein said annular groove (23) at least partly undercuts the valve sealing face (9).

3. The fuel injection valve of claim 1, further comprising an annular furrow (25) on said valve member tip (30), said valve sealing face (9) being embodied on a frustoconical face between and annular groove (23) and said annular furrow (25).

4. The fuel injection valve of claim 3, wherein the cone angle (β) of said valve sealing face (9) is larger than the cone angle (α) of said valve seat (11).

5. The fuel injection valve of claim 4, wherein the difference (ϕ) of the cone angles (α, β) of said valve seat (11) and said valve sealing face (9) is less than 1°.

6. The fuel injection valve of claim 5, wherein the difference (ϕ) of the cone angles (α, β) of the valve seat (11) and the valve sealing face (9) is 0.25 to 0.75°.

* * * * *